United States Patent [19]

Gibson et al.

[11] Patent Number: 4,790,096

[45] Date of Patent: Dec. 13, 1988

[54] GUN LIFT

[76] Inventors: David E. Gibson; Steven D. Gibson, both of 717 Cynthia St., Alhambra, Calif. 91801

[21] Appl. No.: 146,269

[22] Filed: Jan. 20, 1988

Related U.S. Application Data

[63] Continuation-in-part of Ser. No. 30,079, Mar. 26, 1987, abandoned.

[51] Int. Cl.[4] ..... F41C 29/00

[52] U.S. Cl. ..... 42/94

[58] Field of Search ..... 42/94; 89/37.04; 254/93 R, 93 H

[56] References Cited

U.S. PATENT DOCUMENTS

| | | | |
|---|---|---|---|
| 879,052 | 2/1908 | Jeranek | 42/94 |
| 1,890,423 | 12/1932 | Teagarden | 42/94 |
| 1,990,004 | 2/1935 | Shannon | 254/93 H |
| 2,352,390 | 6/1944 | Kirkland | 254/93 H |
| 2,828,611 | 4/1958 | Johansson et al. | 254/93 H |
| 2,991,579 | 7/1961 | Lies | 42/94 |
| 3,012,350 | 12/1961 | Wold | 42/94 |
| 3,156,062 | 11/1964 | Stevenson et al. | 42/94 |
| 3,703,046 | 11/1972 | Barone et al. | 42/94 |

FOREIGN PATENT DOCUMENTS

| | | | |
|---|---|---|---|
| 908108 | 4/1954 | Fed. Rep. of Germany | 42/94 |

*Primary Examiner*—Charles T. Jordan

*Attorney, Agent, or Firm*—William W. Haefliger

[57] ABSTRACT

A gun universal support lift provides for sand bag adjustable rapid manipulation up and down, together with adjustable swiveling about an upright axis, and also adjustment to controllable V-shape, to support different hand guns in different positions, during shooting; also dual support of sand bags at two different levels, with swiveling, is provided.

14 Claims, 4 Drawing Sheets

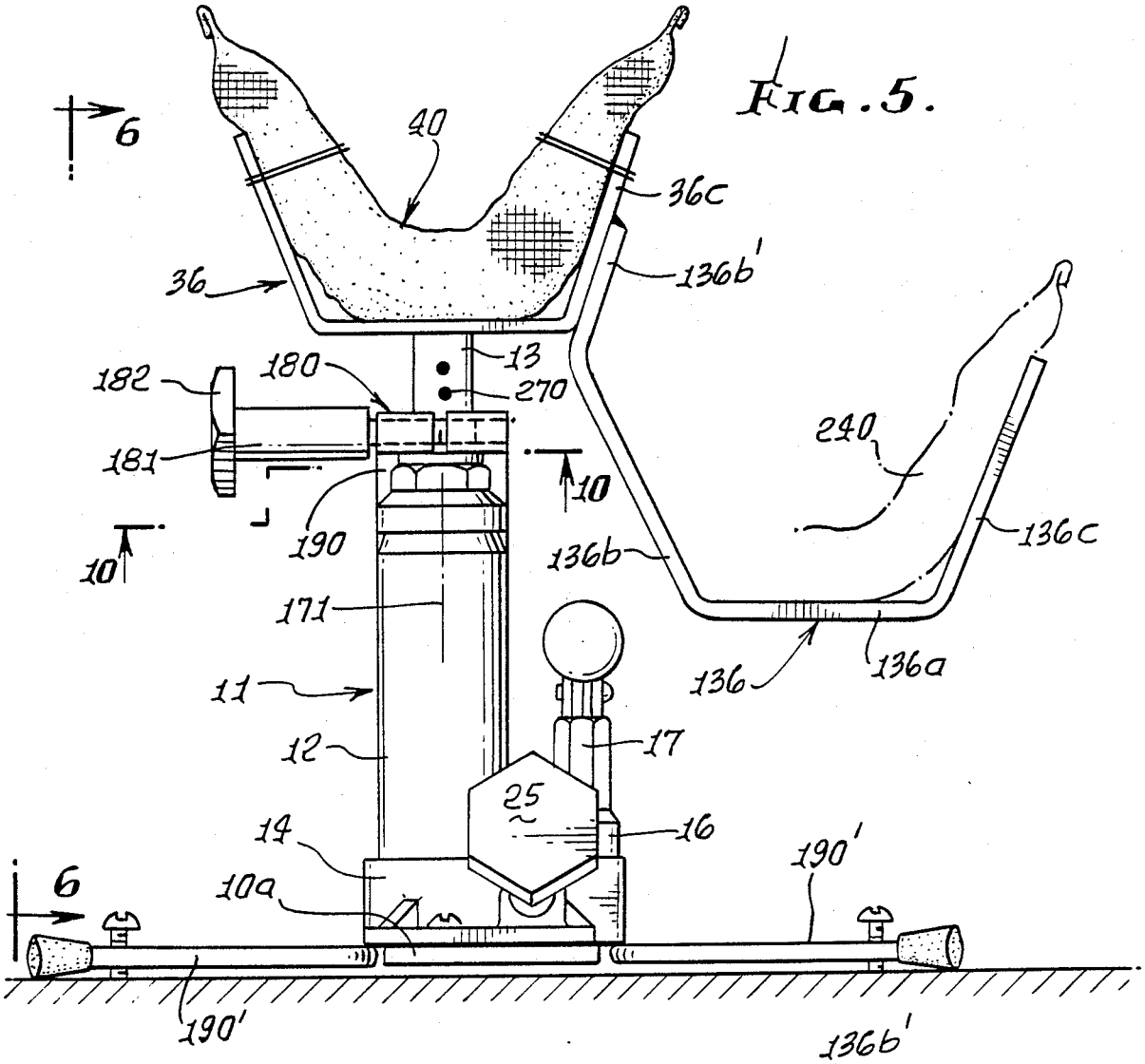
FIG. 5.
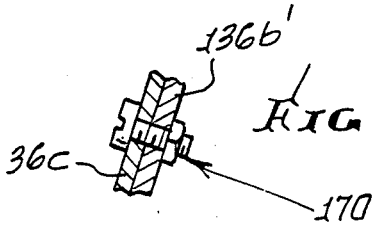
FIG. 8.
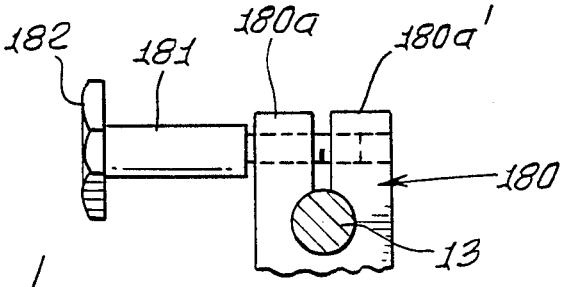
FIG. 10.
FIG. 9.
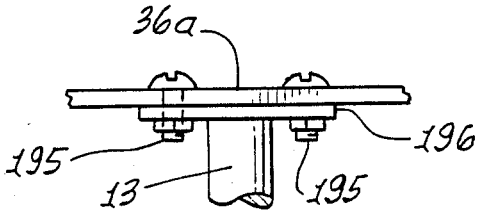

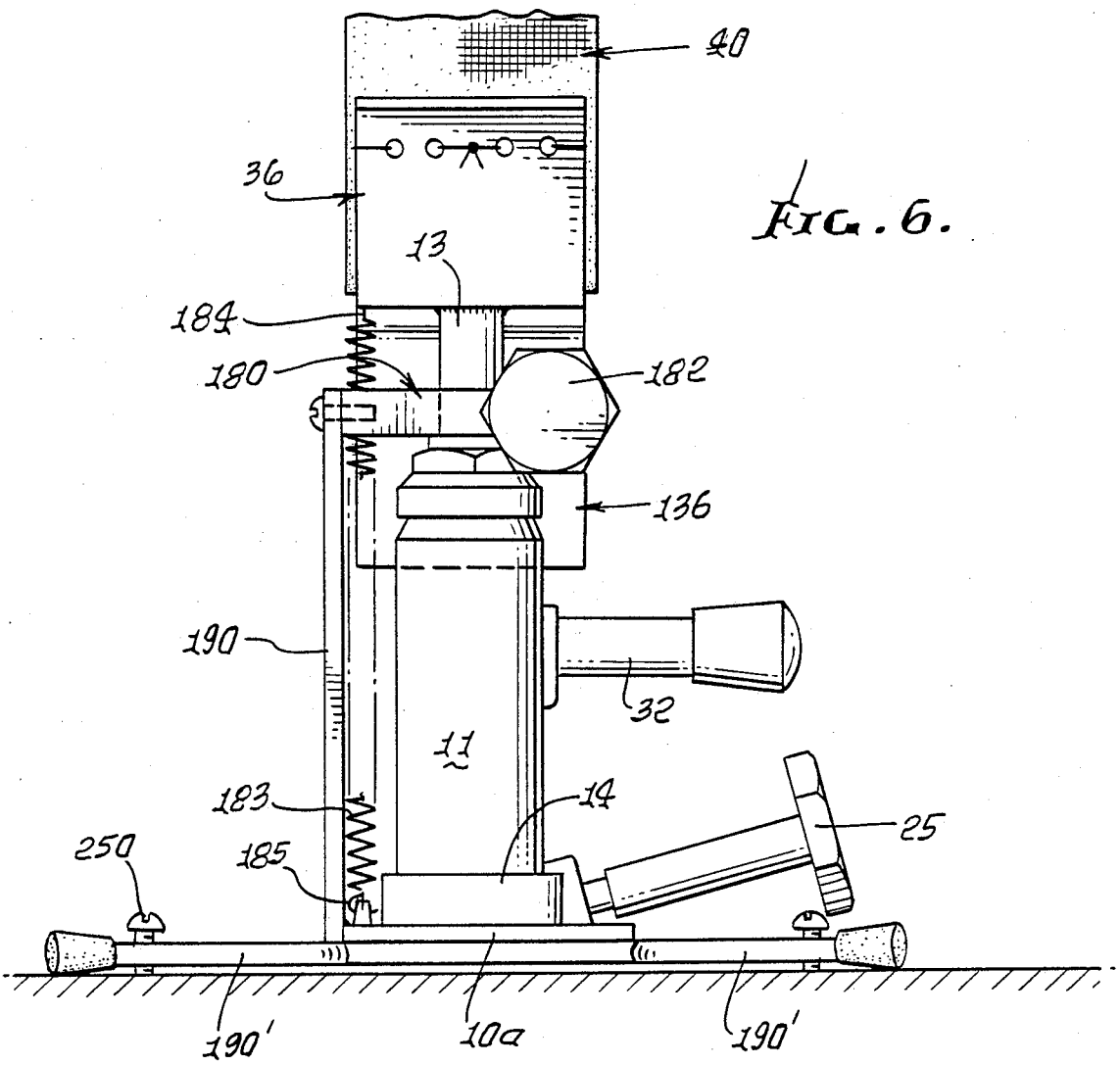
FIG. 6.
FIG. 7.
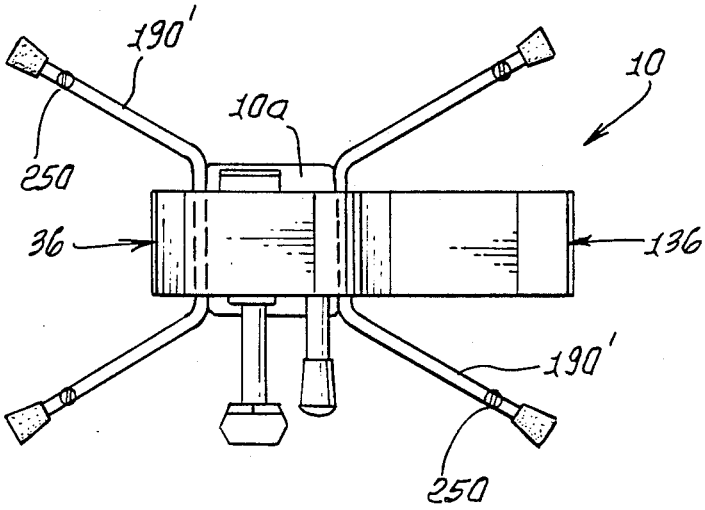

GUN LIFT

BACKGROUND OF THE INVENTION

This application is a continuation-in-part of Ser. No. 30,079, filed Mar. 26, 1987, now abandoned.

This invention relates generally to sighting of handguns, and more particularly supports for handguns used during such sighting, or "sighting-in."

The "sighting" of handguns such as rifles requires accurate support of the gun barrels, since the sights must be precisely adjusted to enable accurate shooting. In the past is was known to employ screw jacks to support such barrels; however, the turning of the support screw one full turn to re-establish the same gun-barrel support resulted in a discrete lowering or elevation of the barrel, by a fixed distance or amount, and frequently such an elevation was greater than that needed for sighting, which limited sighting adjustment accuracy. Non-adjustable sand bags were also employed to support gun barrels, and the user had to tilt the barrel on the sand bag to adjust it during sighting; however, this too resulted in unwanted inaccuracies. There is need for a much more accurate gun supporting systems, for use during "sighting-in."

SUMMARY OF THE INVENTION

It is a major object of the invention to provide a solution to the above problems and difficulties, and to meet the described need. Basically, the gun or pistol sighting and lifting device of the invention comprises:

(a) a base, (b) a vertical actuator mounted on the base, (c) a holder mounted on the actuator to form at least one and preferably two or more upward opening, saddle shaped recesses, and (d) at least one sand bag received in the recess or recesses and supported by the holder to form generally V-shaped walls of a groove which opens upwardly, to in turn support a gunstock, or the hands of person gripping a pistol, (e) whereby the gun or pistol supported by the sandbag V-shaped walls is accurately steaded, for sighting.

As will appear, the holder typically comprises a generally U-shaped plate having upper generally horizontal edges, the sandbag to cover said upper edges; the actuator includes a plunger and cylinder, the plunger supporting the holder to be adjustably rotatable about a vertical axis; and the actuator is preferably an hydraulic actuator, and includes finger operable control means above the base for elevation and lowering of the bag.

Further, the "finger tip" control means preferably includes a reciprocable lever operable via a pump to pump actuating hydraulic fluid to lift the plunger, and a valve control operable to open a valve to drain actuating fluid for lowering the plunger; and the piston in the cylinder is connected with the plunger to lift and lower same, the plunger and piston being pivotable about a vertical axis at all vertical positions of the piston to allow position adjustment of the holder and sandbag.

As will be seen, the holder structure may comprise multiple generally U-shaped plates; two of such interconnected plates may be employed, one plate carried by the actuator and the other plate carried by said one plate, the two plates being at different levels; and the two plates may be connected together at their flanges so that the second U-shaped plate is at a lower level than the first plate, whereby a gun can be rapidly moved between different support levels defined by sand bags in the two U-shaped support plates.

Additionaly, rapid descent of the holder structure can be effected by use of a tension spring extending upwardly and operatively connected between the holder structure and the base for urging the holder structure downwardly thereby to effect more rapid draining of actuating fluid for more rapidly lowering the plunger and said holder structure; and in this regard, the actuator plunger can be locked in a selected rotary position, at any selected level of the holder structure. Also, the holder structure can easily be detached from the plunger as will be seen.

The method of the invention includes:

(i) adjusting one or both of the V-shaped sandbags to form a V-shaped notch to conform to a rifle barrel underside, (ii) and supporting a rifle barrel on the selected sandbag at the bottom of the notch, and (iii) adjusting the angularity, relative to horizontal of the walls of the sandbag at opposite sides of the notch.

These and other objects and advantages of the invention, as well as the details of an illustrative embodiment, will be more fully understood from the following specification and drawings, in which:

DRAWING DESCRIPTION

FIG. 5 is a view like FIG. 1, showing a modification;

FIG. 6 is a side elevation on lines 6—6 of FIG. 5;

FIG. 7 is a reduced size plan view of the FIG. 5 apparatus;

FIG. 8 is a fragmentary section showing a dual flange interconnections;

FIG. 9 is a fragmentary elevation showing a removable connection of a holder to an actuator plunger; and FIG. 10 is a section on lines 10—10 of FIG. 5.

DETAILED DESCRIPTION

Figure 1:
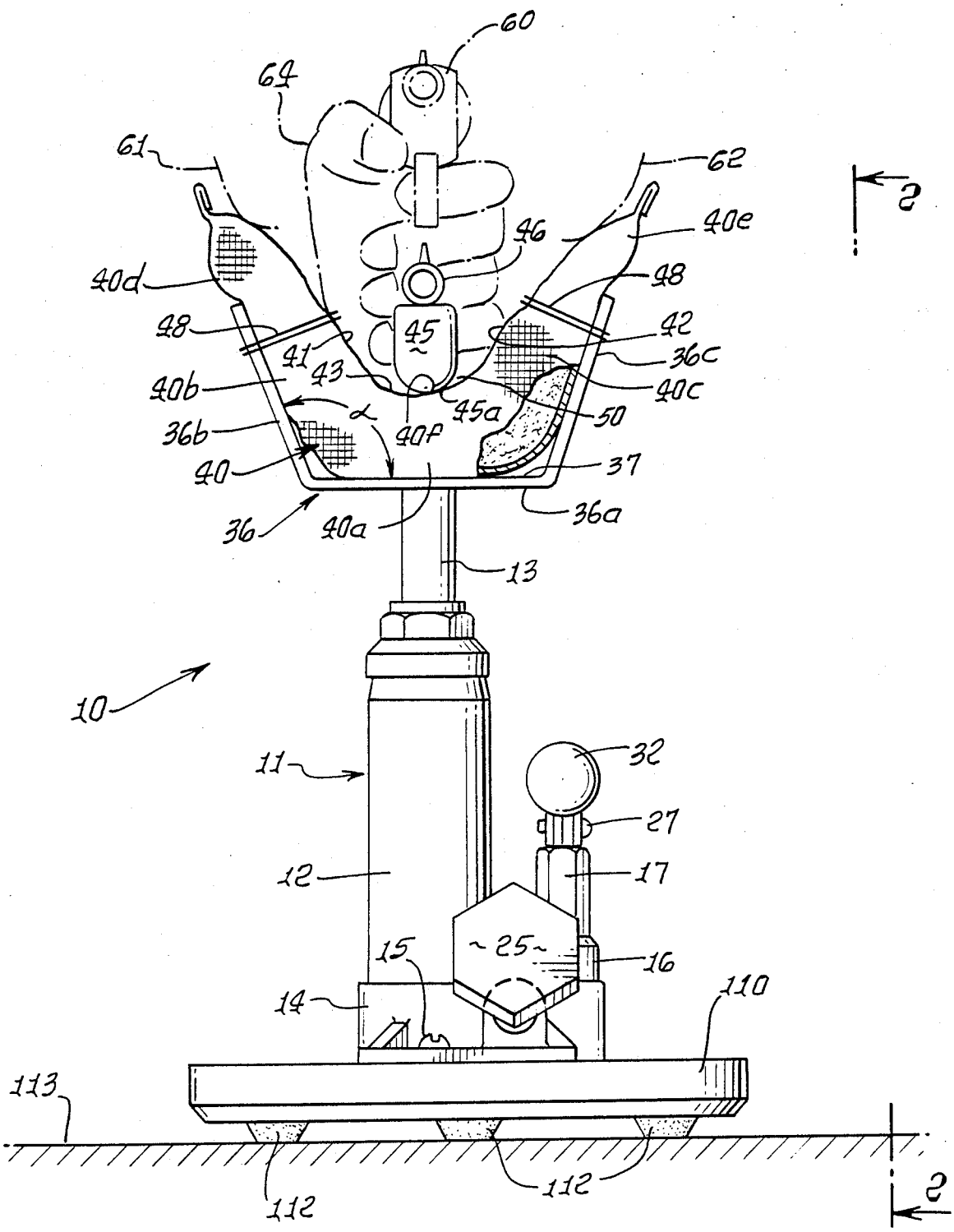
FIG. 1 is a front elevation showing use of the apparatus of the invention.
Figure 2:
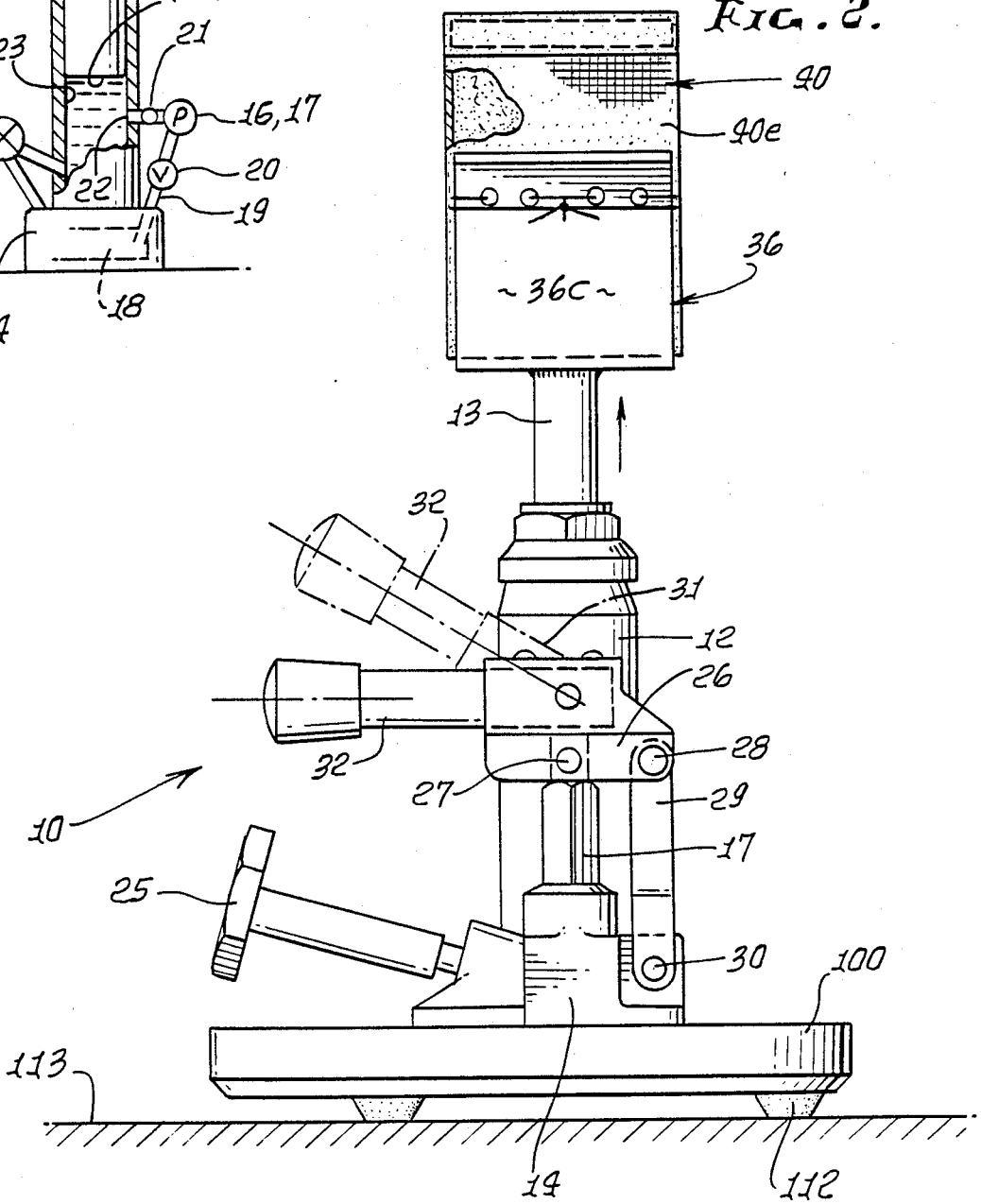
FIG. 2 is a side elevation on lines 2—2 of FIG. 1.

The gun or pistol sighting device 10 shown in FIGS. 1 and 2 includes a base 110, and a vertical actuator 11 mounted on the base. The base may be wooden, it extends horizontally, and it has three or more supports 112 to rest on the ground or other surface 113. The base is wide enough —eight inches or more—to resist toppling of the device. The actuator 11 is hydraulic, and includes an upright cylinder 12 and a plunger 13 projecting upwardly therefrom. The cylinder is carried on an integral, enlarged section 14 attached to the base as by fasteners 15.

Figure 3:
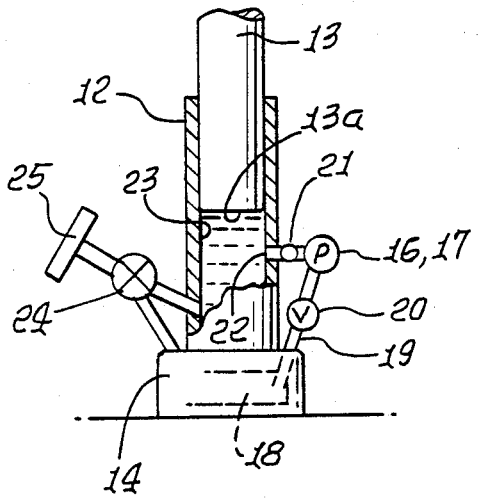
FIG. 3 is an elevation, in section, showing a control system.

Attached to the section 14 is a sub-cylinder 16, extending upright adjacent cylinder 12. Located within 16 is a sub-plunger 17 adapted to be reciprocated up and down. Referring to FIG. 3, as the sub-plunger is moved up, it draws hydraulic fluid from reservoir 18 through passage 19 and valve 20; and as the sub-plunger is moved down, it displaces fluid through valve 21 and passage 22 to the chamber 23, within the main cylinder 12. As liquid fills chamber 23, the piston surface **13*a* of the plunger is forced upwardly, hydraulically. An escape valve 24, controlled by rotary handle 25, controls escape of fluid from chamber 23 back to the reservoir 18, to lower the plunger 13**.

A crank 26 is pivotally attached to the subplunger 17 at 27; and the crank has pivotal attachment at 28 to the upper end of a link 29. The latter is pivotally attached to the section 14 at 30. As crank 26 moves up, say to broken line position 31, and then moves back down, it pumps the liquid into chamber 23, as described above.

Note that the crank handle 32, and the rotary handle 25, both project leftwardly in FIG. 2, and are both available to the right hand of the user who faces the apparatus as in FIG. 1, so that he can very easily raise or lower the plunger 13, through an infinite range of positions, as required for very accurate positioning of a hand-gun or rifle during "sighting-in."

Mounted on the plunger 13 is holder 36 forming an upright opening, i.e., saddle shaped recess 37. The holder may consist of a metal plate, and include a lower section **36*a*, and two side sections 36*b* and 36*c*. Section 36*a* is horizontal and centrally attached to plunger 13; and like sections 36*b* and 36*c* are integral with opposite ends of section 36*a***, and are angled upwardly therefrom at obtuse internal angles $\alpha$, between 100° and 130°.

A sandbag 40 is received in the trapezoidal recess formed by the plate sections, and is supported by those sections to form generally V-shaped walls 41 and 42 of a groove or notch 43 which opens upwardly. That groove in turn centrally supports, above the plunger 13, a gunstock 45, (as in case of rifle sighting-in), the rifle barrel indicated at 46. The laterally and upwardly projecting sections **40*b* and 40*c* of the sandbag seat against the plate sections 36*b* and 36*c*; and the bottom section 40*a* of the sandbag seats on the lower plate section 36*a*. Thongs 48 may be employed to wrap about bag sections 40*b* and 40*c*, and attach them to plate sections 36*b* and 36*c*. The uppermost sections 40*d* and 40*e*** of the sandbag protectively overhang the upper edges of the metal plate sections to prevent injury to the user.

In use, the rifleman places his rifle stock downwardly at 50 for firm support at the concave surface **40*f* of the bag at the bottom of the notch, that concave surface engaging the downwardly convex surface 45*a* of the stock 45. As the rifleman aims the barrel, he can swivel it about the vertical axis of the plunger 13, which swivels in the cylinder 12; also he can raise and lower the holder to any level, without rotating the holder, by operating the handles 32 and 25**, as referred to. This is very conveniently done by right handed manipulation of the controls, as the rifleman lies prostrate, sighting his rifle, to bring the barrel up or down, precisely, to sight a pre-located target, and shooting of the rifle does not distrub the position of the barrel in the sandbag notch.

Figure 4:
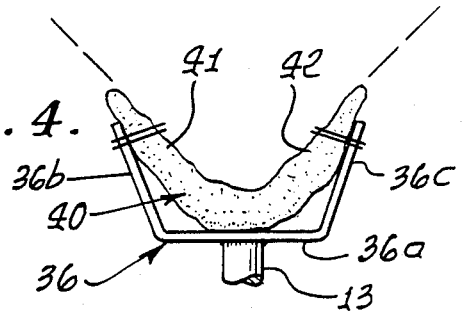
FIG. 4 is a fragmentary view showing sandbag notch adjustment.

The equipment presents a further adjustment in the angularity of the walls 41 and 42 relative to the horizontal. This is done by shifting the sand in the bag, while on the holder 36, as for example to widen angled positions of those walls seen in FIG. 4. This is enabled because of the holder configuration, and width of plate section **36*a* between sections 36*b* and 36*c***.

FIG. 1 also shows use of the device for supporting a pistol 60 as via both hands of the user gripping the pistol. See broken lines 61 and 62 indicating hand engagement with the upper extents of bag walls 41 and 42, both hands being used. Single handed holding of the pistol appears at 64.

The device is well adapted to use for right or left hand of the user.

The device is also well adapted to: varmint shooting, "silhouette" shooting, black powder shooting and as a teaching tool.

It can also be used for gun display purposes.

In the modified form of the invention seen in FIGS. 5–9, the elements the same as or corresponding to those of FIGS. 1–4 bear the same numerals.

A second U-shaped holder 136 is connected to holder 36, to define a larger holder structure than the holder structure seen in FIGS. 1 and 2. Holder 136 is like holder 36 and consists of a metal plate having a lower section **136*a* and two side sections or flanges 136*b* and 136*c***.

Note that section or flange **136*b* has an upward extension 136*b*′ that is angled to be parallel to and to fit flatly against section 36*c*. It may be welded to the latter as shown, or the two may be removably interconnected as by fastener means 170 seen in FIG. 8. The outline of a sandbag appears at 240, in holder 136, which is at a lower level than holder 36, whereby the user can select which level sandbag he wants for supporting his gun, or he can rapidly shift between the two. This together with rapid elevation and lowering as afforded by the actuator 11 allows the user versatility of gun support heretofore unknown. Note that both holders 36 and 136 can be swiveled about the same axis 171, i.e. the axis of plunger 13. A clamp is provided for selectively clamping the plunger in fixed rotary position relative to the plunger. See in this regard the split, U-shaped member 180 attached to plate 190 welded to base 14. It passes the plunger 13, and may be clamped to the plunger by a rotary part 181 thread connected to one of the clamp arms 180*a*. A knob 182 on part 181 controls adjustable rotation of part 181**.

A tension spring 183 extends vertically, and is operatively connected between the holder structure 36 and the base **10*a* for yieldably urging the holder 36 downwardly. See attachment points 184 and 185 for the spring ends. The spring tension urges the holder 36 and plunger 13 downwardly to effect more rapid draining of actuating fluid from the cylinder, thereby achieving more rapid level adjustment of the holders 36 and 136, and the sandbags. One or both holders may support such sandbags, giving the user substantially more gun support options, as well as a wide arc of pivoting of the holder 136 and its sandbag. Spring 183** extends openly so as to deflect and allow pivoting of the holders as described.

Base structure **10*a* carries four legs 190 projecting at different angles and in different quadrants, from the base. See FIG. 7. This prevents tilt of the apparatus, when a heavy sandbag is located in holder 136**.

FIG. 9 shows removable mounting of the actuator plunger 13 to the base section **36*a* of holder 36. See removable fasteners 195 attaching plate section 36*a* to a horizontal plate 196 attached to the top of the plunger. Accordingly, different size holders 36** may be mounted to the actuator.

Provision is also made for both right and left hand user use of the apparatus. Thus, holder 136 may be detached from its connection (as by FIG. 8 fasteners 170) to section **36*c*, and attached by the same fasteners 170 to opposite section 36*b*, as via fastener openings in the latter. To facilitate this, rotary part 181 may then be removed and thread connected endwise oppositely (see 181′ in FIG. 10) to clamp arm 180*a*′**.

FIG. 5 also shows the use of leveling fasteners such as screws 250 threaded vertically into legs 190. Such screws engage the support surface 251 and may be rotatably adjusted, individually, for leveling the apparatus. Such screws may be removed, and stored in threaded openings in plate 190.

Finally, stop or position dots 270 or indicia may be formed on or carried by plunger 13, at vertically spaced locations, to come into view as the plunger is elevated. See FIG. 5. Such dots register with clamp edge 271, to indicate selected and associate elevation of the sandbag gun support 40.

We claim:

1. In a gun or pistol sighting and lifting device the combination comprising:

(a) a base, (b) a vertical actuator mounted on the base, (c) holder structure mounted on the actuator to form multiple, upward opening, saddle shaped recesses, and (d) the recesses adapted to support at least one sandbag received in one of the recesses at selected height, and supported by the holder structure to form generally V-shaped walls of a groove which opens upwardly, to in turn support a gunstock, or the hands of a person gripping a pistol, (e) whereby the gun or pistol supported by the sandbag V-shaped walls is accurately steadied, for sighting, (f) said holder structure comprising a first generally U-shaped plate having upper generally horizontal edges and said sandbag covering said upper edges, (g) and said holder structure also including a second U-shaped plate, one plate carried by the actuator and the other plate carried by said one plate, the two plates being at different levels.

2. The device of claim 1 wherein each plate is channel shaped and has a base section and laterally spaced, upwardly extending flange sections, a flange section of said other plate being connected to a flange section of the one plate so that the base section of the other plate extends at a lower level than the base section of the one plate.

3. The device of claim 2 including connector means removable interconnecting said flange section of the other plate to said flange section of the one plate.

4. The device of claim 2 including means for removably connecting the other plate selectively and alternatively to right and left sides of the one plate.

5. The device of claim 4 wherein the actuator includes a plunger and cylinder, and including adjustably clamp means associated with the cylinder for clamping the plunger in fixed rotary position relative to the cylinder, the clamp means including two clamp parts, and a manually operable clamp screw and knob selectively and alternately operatively connectible endwise oppositely to the clamp parts, to accomodate said connection of the other plate to right and left sides of the one plate.

6. The device of claim 1 wherein the base includes lateral legs, and leveling screw means carried by and adjustably movable vertically relative to the legs.

7. In a gun or pistol sighting and lifting device, the combination comprising:

(a) a base, (b) a vertical actuator mounted on the base, (c) holder structure mounted on the actuator to form multiple, upward opening, saddle shaped recesses, and (d) the recesses adapted to support at least one sandbag received in one of the recesses at selected height, and supported by the holder structure to form generally V-shaped walls of a groove which opens upwardly, to in turn support a gunstock, or the hands of a person gripping a pistol, (e) whereby the gun or pistol supported by the sandbag V-shaped walls is accurately steadied, for sighting, (f) said actuator including a plunger and cylinder, the plunger supporting said holder structure to be adjustable rotatable about a vertical axis, (g) said actuator being an hydraulic actuator and including finger operable control means above the base to control elevation and lowering of the plunger.

(h) and including a tension spring extending upwardly and operatively connected between the holder structure and the base for urging the holder structure downwardly thereby to effect more rapid draining of actuating fluid for more rapidly lowering the plunger and said holder structure.

8. The device of claim 7 including adjustable clamp means associated with the cylinder for selectively clamping the plunger in fixed rotary position relative to the cylinder.

9. The device of claim 7 wherein said control means includes a reciprocable lever operable via a pump to pump actuating hydraulic fluid to lift the plunger, and a valve control operable to open a valve to drain actuating fluid for lowering the plunger.

10. The device of claim 7 wherein the tension spring extends openly and sidewardly of the plunger and cylinder to be laterally deflectible in response to rotation of the plunger and holder structure relative to the cylinder and base.

11. The device of claim 10 including a piston in the cylinder and connected with the plunger to lift and lower same, the plunger and piston being pivotable about a vertical axis at all vertical positions of the piston to allow position adjustment of the holder and sandbag.

12. The device of claim 7 wherein the holder structure is removably mounted on the plunger.

13. The device of claim 12 wherein the holder structure includes multiple U-shaped channels, and connector means removably connecting one of the channels to the top of the plunger.

14. The device of claim 7 including adjustable clamp means on and near the top of the cylinder to clamp the plunger, and height indicating indicia on the plunger to be progressively seen as the plunger rises relative to the cylinder.

* * * * *